United States Patent [19]

Koshelev et al.

[11] 4,319,867

[45] Mar. 16, 1982

[54] END-FACE SEAL FOR ROTARY INTERNAL-COMBUSTION ENGINE

[76] Inventors: Vladimir N. Koshelev, ulitsa Revoljutsionnaya, 42/203, kv. 943; Vyacheslav Meshkov, ulitsa Lunacharskogo, 8, kv. 371; Boris V. Chaplanov, ulitsa Dzerzhinskogo, 77, kv. 172, all of Tolyatti, Kuibyshevskoi oblasti, U.S.S.R.

[21] Appl. No.: 35,459

[22] Filed: May 3, 1979

[30] Foreign Application Priority Data

May 4, 1978 [SU] U.S.S.R. ..... 2615607

[51] Int. Cl.[3] ..... F01C 19/04; F01C 19/08

[52] U.S. Cl. ..... 418/113; 418/142

[58] Field of Search ..... 418/113, 119–124, 418/142

[56] References Cited

U.S. PATENT DOCUMENTS

| | | | |
|---|---|---|---|
| 1,237,768 | 8/1917 | Ferguson et al. | 418/142 |
| 3,046,069 | 7/1962 | Schmidt | 418/142 |
| 3,131,945 | 5/1964 | Scherenberg et al. | 418/142 |
| 3,139,233 | 6/1964 | Simonsen | 418/142 |
| 3,820,925 | 6/1974 | Uchiyama et al. | 418/142 |
| 3,975,125 | 8/1976 | Mizutani et al. | 418/142 |

FOREIGN PATENT DOCUMENTS

| | | | |
|---|---|---|---|
| 2432709 | 7/1975 | Fed. Rep. of Germany | 418/142 |
| 2522860 | 12/1976 | Fed. Rep. of Germany | 418/142 |

*Primary Examiner*—John J. Vrablik

*Attorney, Agent, or Firm*—McAulay, Fields, Fisher, Goldstein & Nissen

[57] ABSTRACT

An end-face seal for the rotary internal-combustion engine incorporating seal strips received pairwise within each of the grooves running peripherally in the end face of the rotor between seal elements provided at the apexes of the rotor, said seal strips being resiliently pressed against the working surfaces of the end walls of the engine housing. One of said seal strips received within each of said grooves is resiliently pressed against the seal element provided at the associated apex of the rotor and leading said seal strip when the rotor is set rotating.

4 Claims, 3 Drawing Figures

END-FACE SEAL FOR ROTARY INTERNAL-COMBUSTION ENGINE

FIELD OF THE INVENTION

The present invention relates to engine engineering and, more specifically, to end-face seals for rotary internal-combustion engines. The end-face seal disclosed can be used to advantage in rotary engines designed to propel passenger cars. Yet, an engine incorporating the end-face seal disclosed can also find application as a prime mover of other vehicles.

There is known a rotary internal-combustion engine the housing whereof forms, in conjunction with the end walls; a working chamber of trochoidal shape contained wherein is the multi-apex rotor which is journaled to the eccentric shaft. The housing, end walls and rotor in their turn form chambers of variable volumes which are kept gas-tight owing to the sealing means, including those of the end-face type, the rotor is fitted with. The end-face seal incorporates spring-loaded seal strips received within the associated grooves running peripherally in the end faces of the rotor between the seal elements provided at the apexes of the rotor. Each of the grooves accommodates just one seal strip (cf. for example, U.S. Pat. No. 3,142,439). However, the clearances between the end of each seal strip and the associated seal element provided in the known end seal to facilitate the job of assembling the seal and to cater for thermal expansion impair the sealing effect and are likely to cause gas leakage from one chamber into another.

Also known in another rotary internal-combustion engine with a trochoidal working chamber the sealing means whereof incorporate a pair of side sealing strips received within each of the grooves running peripherally in the end faces of the rotor (cf. U.S. Pat. No. 3,830,600). Said end-face seal with two sealing strips displays an improved sealing effect attributed to a labyrinth existing between the seal strips but fails to offer a solution to the problem of gas leakage, for such leakages do exist through clearances between the ends of the seal strips and the seal elements provided at the apexes of the rotor.

It is an object of the present invention to provide an end-face seal for the rotary internal-combustion engine which eliminates gas leakage between the ends of the seal strips and the seal elements located at the apexes of the rotor.

Another object of the present invention is to enhance the economy of the engine.

A further object of the present invention is to reduce the labour requirements for the manufacture of the seal strips the end-face seal employs and to cut, consequently, the cost.

In accordance with said and other objects there is disclosed an end-face seal for the rotary internal-combustion engine incorporating seal strips which are received pairwise within each of associated grooves running in the end faces of the rotor between seal elements provided at the apexes of the rotor and are resiliently pressed against the working surfaces of the end walls of the engine housing wherein, in accordance with the invention, one of the seal strips received within each of the grooves is resiliently pressed against the seal element provided at the associated apex of the rotor and leading said seal strip when said rotor is set rotating.

It is expedient to obtain the resilient pressing of one seal strip to the associated seal element by virtue of a flat corrugated spring engaging the seal strip with one of its ends and the rotor with the other end. This ensures a reliable sealing engagement of the seal strips with the surface of the end walls of the engine housing and reliably fixes the elastic element in the requisite position so as to press the seal strips against the seal elements provided at the apexes of the rotor with a force of specified value.

It is also expedient that the other seal strip received within each of the grooves is resiliently pressed against the seal element which trails said seal strip when the rotor is set rotating.

It is further expedient to obtain the resilient pressing of the seal strips against the respective seal elements by virtue of a flat corrugated spring engaging one of the seal strips with one of its ends and the other seal strip with the other end.

An arrangement like this one ensures a reliable sealing engagement of the ends of the seal strips, with the seal elements even then when the friction forces coming into play between the other seal strip and the surface of the end wall when the rotor is set rotating are too low to provide for a leakproof engagement of the end face of said seal strip and the associated seal element as this can be the case at an early instant of starting the engine.

The end-face seal disclosed enhances the sealing effect obtained inside the working chambers and, consequently, improves the economy of the rotary internal-combustion engine and also reduces the labour requirements for the manufacture of the seal strips and the machining of the grooves in the rotor, for the accuracy standards to be followed during said jobs can be lower than ever before.

A preferred embodiment of the present invention will now be described by way of an example with reference to the accompanying drawings in which.

Figure 1:
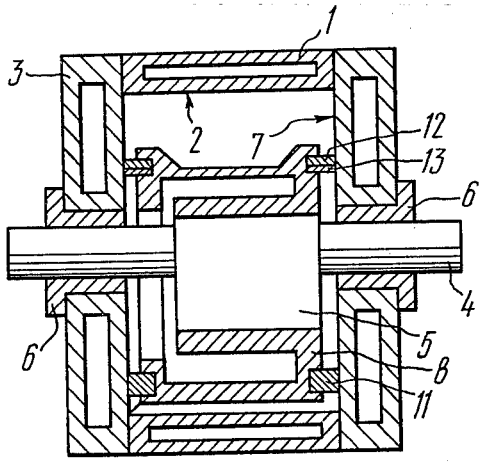
FIG. 1 is a schematic sectional elevation of the rotary internal-combustion engine.

Referring to FIG. 1, the rotary internal-combustion engine comprises a housing 1 with an internal surface 2 of trochoidal shape, end walls 3 of the housing 1 and an eccentric shaft 4 with an eccentric 5, said shaft rotating in bearings 6 fitted to the end walls 3. Said end walls 3 are provided with a working surface 7, and a multi-apex rotor 8 is journaled to the eccentric 5.

Figure 2:
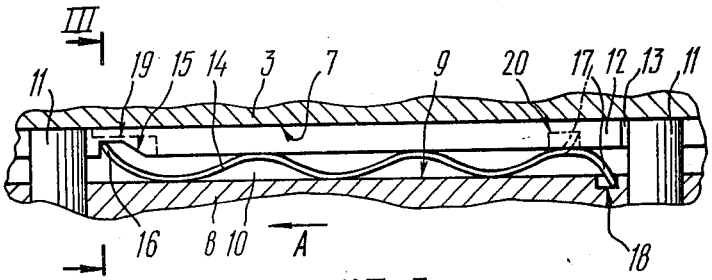
FIG. 2 is a section through the rotor and an end wall of the engine housing in the plane of the end-face seal.
Figure 3:
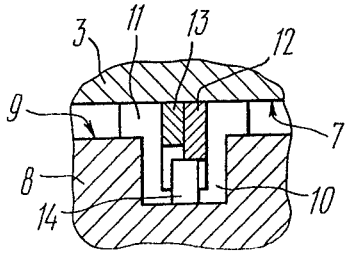
FIG. 3 is a section on line III—III of FIG. 2.

The rotor 8 is provided with grooves 10 running in the end walls 9 parallel to its peripheral edge between seal elements 11 provided at the apexes of the rotor 8. The seal elements 11 are of cylindrical shape. Received within each of the grooves 10 are two seal strips 12 and 13 which are pressed to the surface 7 of the end wall 3 by means of a spring 14 which is of the flat corrugated shape. A recess 15 (FIG. 2) provided in the seal strip 12 serves to link said strip with the spring 14, an end 16 of said spring engaging said recess. The other end 17 of the spring 14 abuts against a recess 18 provided in the rotor 8 so that said spring is in tensioned condition and the seal strip 12 is shifted towards the seal element 11 which leads said seal strip when the rotor 8 is set rotating as indicated by arrow "A". A recess 19 (shown in dot lines) provided in the seal strip 13 serves to keep the end 16 of the spring 14 engaging the recess 15 clear of said seal strip.

In another embodiment of the present invention the seal strip 13 is provided with a recess 20 (shown in dot-and-dash line) engaged by an end 17 of the spring 14. As a result, the seal strips 12 and 13 are simultaneously pressed towards the seal elements 11 which lead and trail, respectively, said seal strips when the rotor 8 is set rotating as indicated.

The end-face seal disclosed operates on the following lines. The clearances between the ends of the seal strips 12 and 13 and the associated seal elements 11 are taken up at one end due to the shifting of the seal strip 13 by the friction forces coming into play at the surface 7 and, at the other end, owing to the displacement of the seal strip 12 under the action of the spring 14. Alternatively, when the spring 14 engages the recesses 15 and 20 with its ends 16 and 17, respectively, the sealing effect is obtained due to the shifting of the seal strips 12 and 13, respectively, towards the seal elements 11 under the action of the spring 14.

The end-face seal designed as indicated above displays an enhanced sealing effect, consequently improving the economy and increasing the output of rotary internal-combustion engines. It also facilitates the starting of the engine from cold. The inherent feature of each seal strip to shift and to take up the clearance existing between its end and the associated seal element paves the way to specifying less stringent requirements in point of the length of the seal strips while manufacturing them. There is also no further need to use seal strips of the right length so as to ensure the specified clearance between the ends of the seal strips and the associated seal elements while assembling each end-face seal.

The fact that the clearance between each seal strip and the seal element is eliminated reduces the leaks of working fluid which is a factor boosting the output of the engine, enhancing its economy and facilitating the starting. Tests have proved that gas leakages are reduced by 15 percent. Less stringent accuracy standards to be observed in manufacturing the seal strips are conducive to cutting the cost.

What is claimed is:

1. An end-face seal for the rotary internal-combustion engine the rotor whereof is contained in the working chamber formed by the engine housing and its end walls, said end-face seal comprising seal elements located at the apexes of said rotor, grooves running in the end faces of said rotor at the periphery thereof between said seal elements, seal strips received pairwise within each of said grooves; each seal strip extending substantially the entire length of its respective groove, said seal strips resiliently pressed to the working surfaces of said end walls of said engine housing, one of said seal strips received within each of said grooves is resiliently pressed to one of said seal elements which leads said seal strip when said rotor is set rotating, the resilient pressing of said seal strip being accomplished by action of a spring member directly on to said seal strip.

2. The end-face seal as claimed in claim 1 wherein the resilient pressing of one of said seal strips to the associated said seal element is by virtue of a flat corrugated spring engaging said seal strip with one of its ends and said rotor with the other end.

3. The end-face seal as claimed in claim 1 wherein the other said seal strip received within each of the associated said groove is resiliently pressed to the apex seal element which trails said seal strip when said rotor is set rotating.

4. An end-face seal for the rotary internal-combustion engine the rotor whereof is contained in the working chamber formed by the engine housing and its end walls, said end-face seal comprising seal elements located at the apexes of said rotor; grooves running in the end faces of said rotor at the periphery thereof between said seal elements; seal strips received pairwise within each of said grooves; flat corrugated springs each accommodated in each of said grooves and each engaging one of said seal strips with one of its ends and also engaging the other of said seal strips with the other end while the corrugations of each said spring are in contact with each of said seal strips so that each of said seal strips is resiliently pressed against the working surface of each of said end wall of said engine housing, one of said seal strips being resiliently pressed to that seal element which leads said seal strip when said rotor is set rotating, the resilient pressing of said seal strip being accomplished by action of said spring directly on to said seal strip and the other of said seal strips being resiliently pressed to the other said seal element which trails said seal strip when said rotor is set rotating.

* * * * *